US005184855A

United States Patent [19]

Waltz et al.

[11] Patent Number: 5,184,855

[45] Date of Patent: Feb. 9, 1993

[54] ELECTROMAGNETIC DOOR LOCK ASSEMBLY

[75] Inventors: Kevin P. Waltz; William P. Dye; Donald D. Baker, all of Indianapolis, Ind.

[73] Assignee: Von Duprin, Inc., Indianapolis, Ind.

[21] Appl. No.: 812,713

[22] Filed: Dec. 23, 1991

[51] Int. Cl.[5] ..... H01H 47/00; E05C 17/56

[52] U.S. Cl. ..... 292/251.5; 361/155; 361/144; 292/341.16

[58] Field of Search ..... 361/144, 155; 292/251.5, 144, 341.16

[56] References Cited

U.S. PATENT DOCUMENTS

| | | | |
|---|---|---|---|
| 3,549,955 | 12/1970 | Paine | 361/155 |
| 3,629,663 | 12/1971 | Butkus | 361/144 |
| 4,439,808 | 3/1974 | Gilham | 361/144 |
| 4,603,370 | 7/1986 | Imazeki et al. | 361/155 |
| 4,607,311 | 8/1986 | Brown et al. | 361/155 |
| 4,682,801 | 7/1987 | Look et al. | 292/251.5 |
| 4,716,490 | 12/1987 | Alexanian | 361/155 |
| 4,777,556 | 10/1988 | Imran | 361/155 |
| 4,981,312 | 1/1991 | Frolov | 292/251.5 |
| 5,016,929 | 5/1991 | Frolov | 292/251.5 |
| 5,065,136 | 11/1991 | Frolov et al. | 292/251.5 |

*Primary Examiner*—Eric K. Nicholson
*Attorney, Agent, or Firm*—Robert F. Palermo; A. James Richardson

[57] ABSTRACT

An electromagnetic door lock assembly employs an electromagnet positioned in a frame adjacent to a door, power source for providing power to the electromagnet, and an adjustable armature assembly positioned in the door for interaction with the electromagnet. The armature assembly includes an armature plate having a front surface and a back surface opposite from the front surface, a backing plate situated adjacent to the back surface of the armature plate, a stem coupling the backing plate to the armature plate including a spring biasing the backing plate and armature plate toward each other, a mounting plate for mounting the armature assembly to a door to be locked, adjusting screws for adjustably positioning the backing plate at a fixed position with respect to the mounting plate so that the armature plate is positioned at a first position for optimum interaction with the electromagnet, the screws having elongated heads for maintaining the relative alignment between the armature plate and the mounting plate as the armature plate moves between said first position and a position contiguous to the electromagnet.

33 Claims, 3 Drawing Sheets

ELECTROMAGNETIC DOOR LOCK ASSEMBLY

BACKGROUND OF THE INVENTION

The present invention relates generally to electromagnetic door locking devices and particularly to shear locks having improved features which ensure that the lock operates rapidly and positively during both locking and unlocking operations.

Various types of electromagnetic door locks are known. One type commonly referred to as a shear lock comprises an electromagnet mounted to or in a frame defining a doorway. An armature is movably mounted to travel with a door as the door moves in the doorway between an "open" and "closed" position. When the door is in the closed position, the armature is positioned in spaced relation from the electromagnet, but is mounted to or in the door such that when power is applied to the electromagnet the armature responds to the magnetic field and becomes engaged on an adjacent surface of the electromagnet.

Various styles and types of shoulder means such as ledges, tangs, and tabs have been employed to provide some physical interrelationship between the face of the electromagnet and the armature so as to enhance the lock's resistance to a shearing movement which would result from any attempt to open the door while power was applied to the electromagnet. On occasion, the various styles of shoulder means have provided sufficient mechanical interaction that, upon the removal of power from the electromagnet, the armature has failed to release from the face of the electromagnet. Such failure, to release can also occur due to residual magnetic fields remaining after the removal of Power from the electromagnet, or other causes.

It has been recognized that to insure proper disengagement between the electromagnet and the armature when power is removed from the electromagnet, some biasing means can be provided. Particularly where the armature is mounted in or on the top of the door, this biasing means acts in addition to any gravitational action on the armature itself to enhance the disengagement of the armature and electromagnet upon removal of power from the electromagnet. Examples of prior art devices which include such biasing means are found in U.S. Pat. Nos. 5,016,929 and 5,033,779.

The additional disengagement force provided by the biasing means must be compensated for during the locking or engaging operation between the electromagnet and the armature. While it would seem to be possible to provide electromagnets of substantially increased size and field strength so as to overcome the additional force provided by the biasing means, such an electromagnet can be significantly more expensive to make and proportionally more difficult to properly install.

It would therefore be advantageous to provide and electromagnetic door locking assembly which includes appropriate biasing to insure positive unlocking action between the armature and electromagnet and to provide appropriate means to insure rapid positive locking operation despite the presence of the biasing means.

SUMMARY OF THE INVENTION

An electromagnetic door lock assembly according to the present invention comprises an electromagnet positioned at a fixed location with respect to a frame defining the doorway. An adjustable armature assembly is positioned to travel with the door mounted in the doorway to a position of interaction with the electromagnet when the door is closed. The armature assembly includes an armature plate and biasing means for biasing the armature plate away from the electromagnet so as to insure positive disengagement of the armature from the electromagnet when power is removed from the electromagnet. The power means for providing power to the electromagnet includes an enhancing means for developing an initial enhanced current through the electromagnet to assure armature plate attraction to the electromagnet against the added force provided by the biasing means.

The various features and advantages of a door lock assembly including the electronic circuit will become apparent to those skilled in the art upon consideration of the following detailed description of preferred embodiments exemplifying the best mode of carrying out the invention as presently perceived. The detailed description particularly refers to the accompanying drawings.

DESCRIPTION OF THE PREFERRED EMBODIMENT

Figure 1:
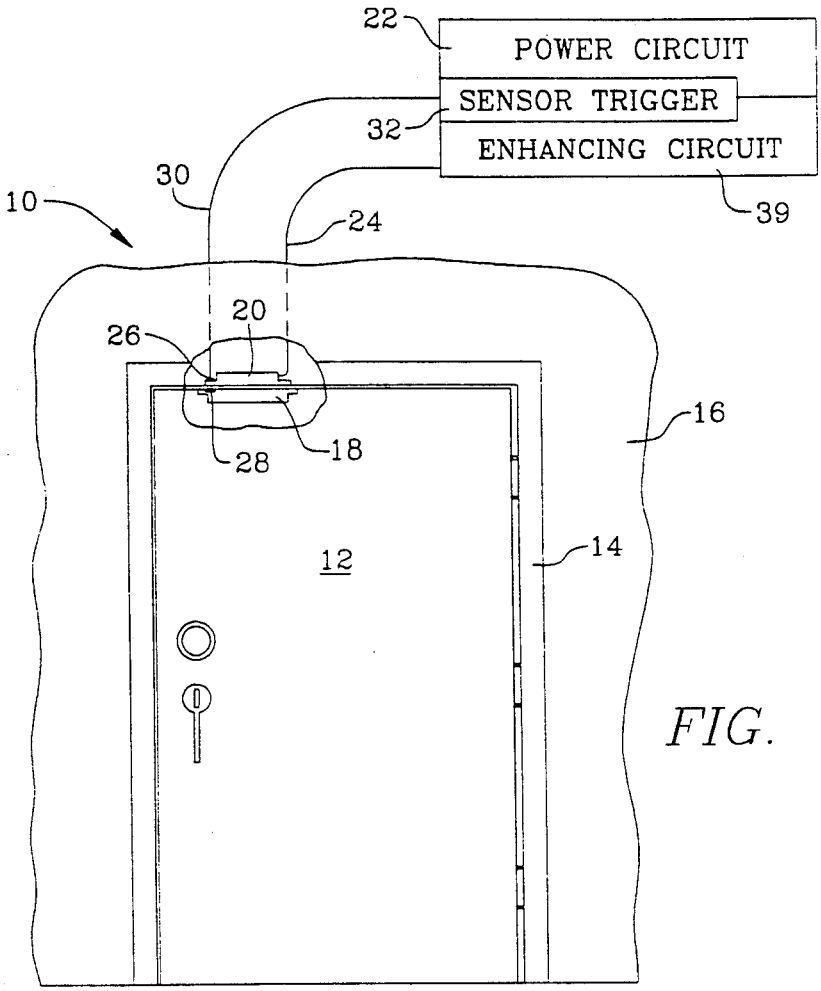
FIG. 1 is a partially schematic view of a door in a doorway employing an electromagnetic door lock assembly according to the present invention.

An electromagnetic door lock assembly 10 in accordance with the present invention as shown in FIG. 1 in connection with a door 12 shown in a closed position closing a doorway defined by a frame 14 outlining the door way opening in wall 16. An adjustable armature assembly 18 is shown mounted to the top of door 12 and positioned for interaction with the electromagnet 20 which is shown fixed in the top of frame 14. The electromagnet 20 is powered by a power circuit 22 described more fully in connection with FIG. 7. The power circuit provides power to the electromagnet 20 through power cable 24 only after the door 12 is sensed to be in a closed position as shown in FIG. 1. The sensing is achieved by a magnetic sensor 26 positioned adjacent to the electromagnet and senses the magnetic field provided by a small permanent magnet 28 mounted in the top of the door adjacent to or as a part of armature assembly 18. When the sensor 26 senses magnet 28 a signal is provided through cable 30 to a sensor trigger circuit 32 which, after an appropriate time delay described later, causes a momentary application of an enhanced amount of current through cable 24 to the electromagnet by an enhancing circuit 34. Other conventional controls for the power circuit are of course provided, but not illustrated.

Figure 2:
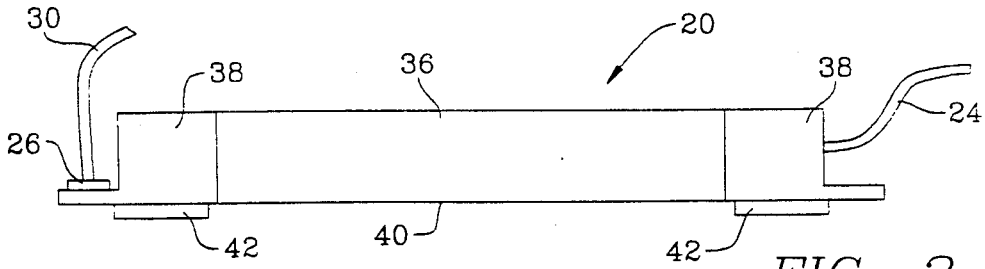
FIG. 2 is a side elevation of an electromagnet employed in a door lock assembly according to the present invention.

The electromagnet 20 comprises a coil potted in a housing 36 as shown in FIG. 2. The housing includes mounting portions 38 at each end of the coil which are adapted to be secured to the frame 14 by screws or other similar means. The electromagnet includes a lower face 40 adapted to the contact by the armature when power is applied to the coil through the power cord 24. Shoulder means in the form of elongated projections 42 are provided to interact with operating structure on the armature so as to enhance the lock's resistance to any applied shearing force.

Figure 3:
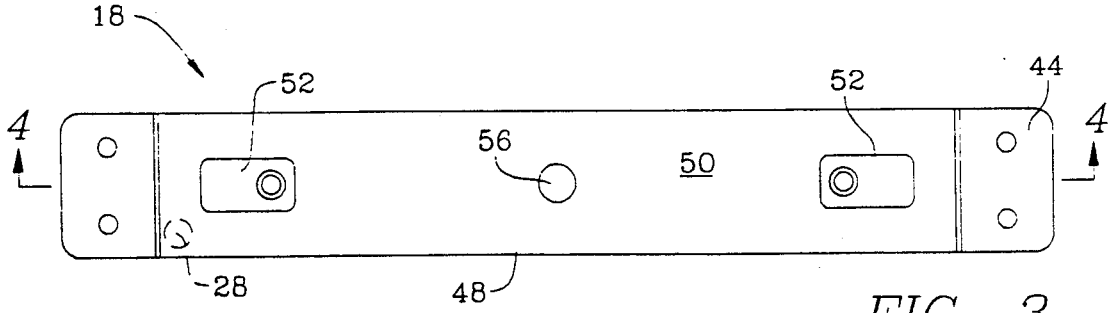
FIG. 3 is a plan view of an armature assembly designed for interaction with the electromagnet of FIG. 2.
Figure 4A:
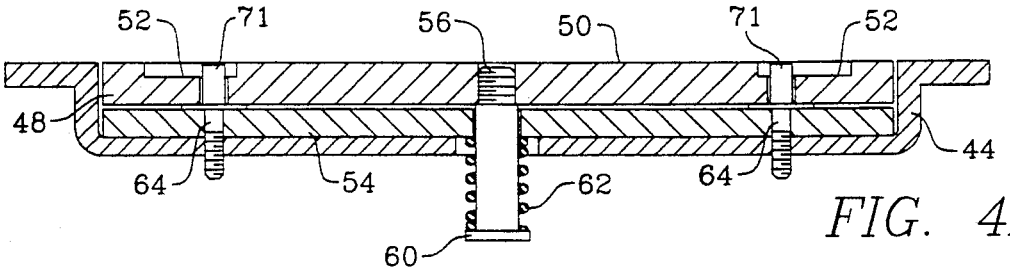
FIG. 4 shows three sectional views of the armature assembly shown in FIG. 3 taken along section line 4—4.
Figure 4B:
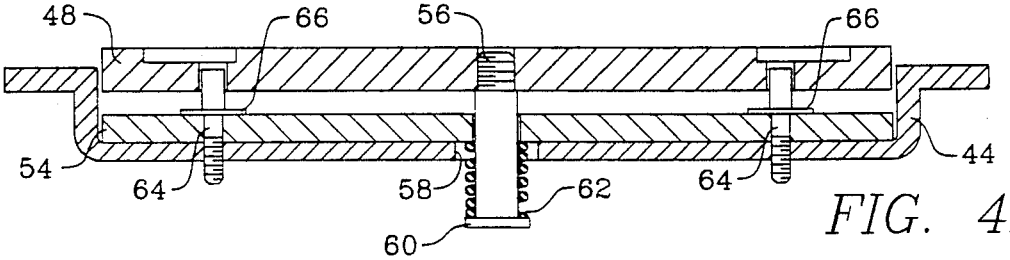

One embodiment of the armature assembly 18 is shown in FIGS. 3 and 4 to comprise a mounting plate 44 defining a central channel 46 which receives an armature plate 48 having an upper surface 50 confronting and intended to contact surface 40 of the electromagnet 20. The upper surface 50 of the armature plate 48 includes longitudinal groves 52 dimensioned to engage projections 42 on the mounting portions 38 when power is applied to the electromagnet 20. The armature plate 48 is coupled to a separate backing plate 54. In the presence of a magnetic field generated by the electromagnet 20, the armature plate 48 moves with respect to the backing plate 54 between the two positions shown for example in FIGS. 4A and 4B. In FIG. 4A, armature plate 48 and backing plate 54 are both in a lower "unlocked" position. In FIG. 4B, the armature plate 48 is an elevated "locked" position while the backing plate 54 is in the same position shown in FIG. 4A.

A stud or similar element 56 is secured to the armature plate 48 and projects through an opening in backing plate 54 and through another opening 58 in mounting plate 44. The stud 56 includes an outwardly projecting flange 60 at a rear most end of the stud. A coil spring 62 surrounds the stud with one end of the spring contacting the flange 60 and the other end of the spring contacting a back surface of the backing plate 54. The spring 62 acts as a biasing means for biasing the flange 60 away from backing plate 54 which has the effect of biasing the backing plate 54 and armature plate 48 toward each other. Thus, the position of the armature plate 48 shown in FIG. 4B cannot be sustained against the application of the biasing force provided by spring 62 without some outside force such as the magnetic force provided by the electromagnet 20. Thus, FIG. 4A shows the position of the armature assembly when the door is "unlocked" while FIG. 4B shows the relative position of the various elements of the armature assembly when power has been applied to the electromagnet and the door is "locked".

Figure 4C:
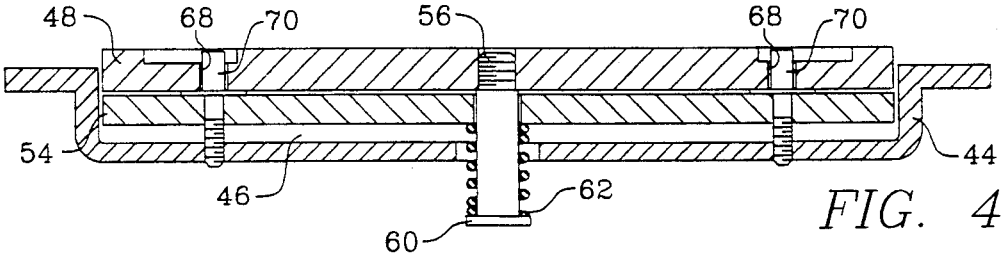

A pair of threaded studs 64 are provided which are adjustably engaged to the mounting plate 44. Each of the studs 64 includes an integral radial flange 66. Any outward adjustment of the studs 64 with respect to the frame 44 caused the flanges 66 to move out thereby displacing the armature plate 48 toward the electromagnet as shown in FIG. 4C. Any outward adjustment of the rest position of the armature plate 48 by adjustment of the threaded studs 64 also causes the backing plate 54 to move outward since the backing plate 54 and armature plate 48 are biased toward each other by spring 62 as previously described. From the new position shown in FIG. 4C, the armature plate 48 can be attracted to the electromagnet 20 against the gravitational force as well as the force provided by the biasing spring 62. It will be noted that the biasing force is set by the spring constant of spring 62 and is independent of the adjustment of threaded studs where the distance of separation between the backing plate 54 and armature plate 48 are the same. The movement of the armature plate in response to an applied magnetic field is guided by means of openings 68 which surround the upper portion 70 of the threaded studs 64. The upper ends 71 of the studs 64 are substantially coplanar with the upper surface 50 of the armature plate 48 when the assembly is in the unlocked position shown in FIG. 4A. Thus, the guiding function provided by the interaction between the openings 68 and the upper portions 70 operates over a range of movement equal to the thickness of the armature plate 48.

Figure 5:
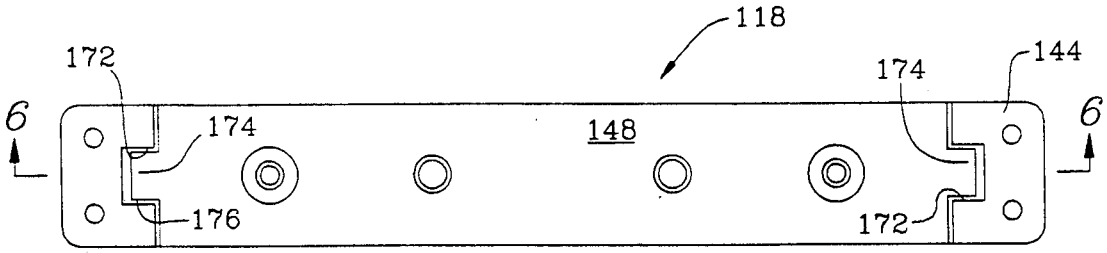
FIG. 5 is a plan view of an alternative embodiment of an armature assembly according to the present invention.
Figure 6A:
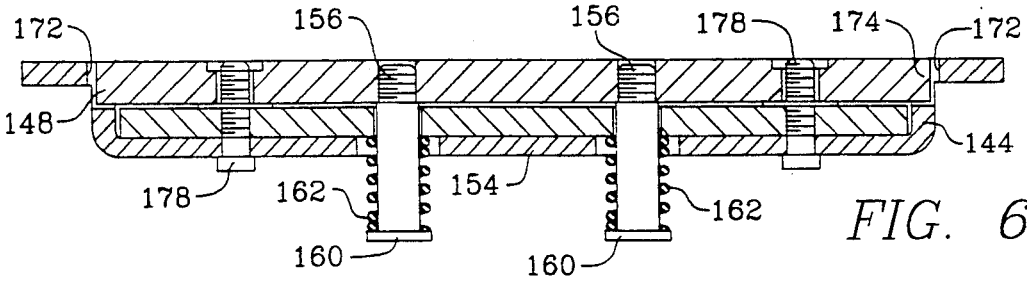
FIG. 6 shows three sectional views of the armature assembly of FIG. 5 taken along line 6—6.
Figure 6B:
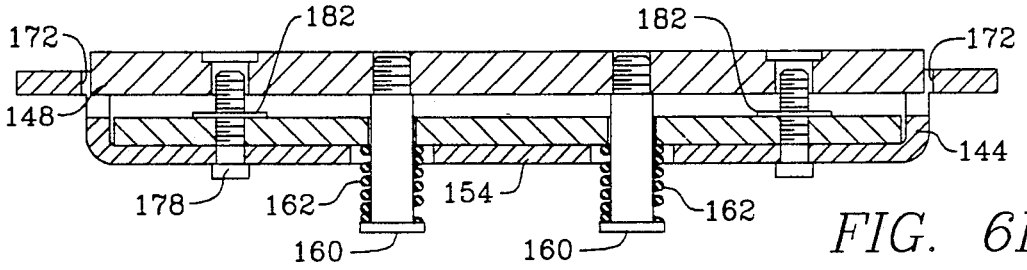
Figure 6C:
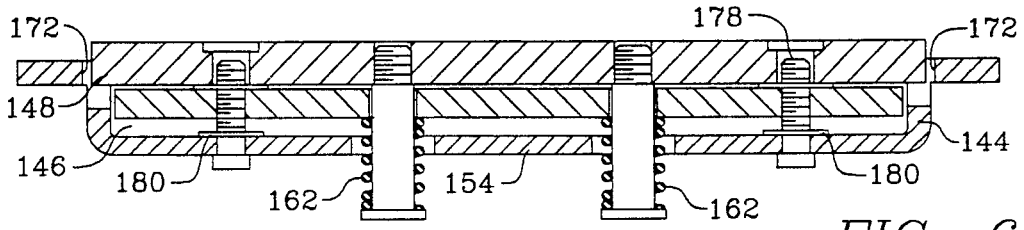

An alternative embodiment for the armature assembly 18 is shown in FIGS. 5 and 6. In the alternative embodiment, the armature assembly 118 includes a channel shaped mounting plate 144 having a central channel 146 receiving armature plate 148 and backing plate 150. The biasing arrangement provided by studs 156, including flanges 160 and springs 162, is similar to that shown in FIGS. 3 and 4. Each end of the mounting plate 144 includes a slot 172 which received a projecting tang portion 174 of armature plate 148. The sides of 176 of projecting tang 174 cooperate not only with the sides of slots 172 but also with appropriate tabs for shoulders provided on a cooperating electromagnet such as that shown in U.S. Pat. No. 5,000,497.

The position of the armature plate 148 relative to mounting plate 144 is determined by threaded screws 178 which are fixed for rotation with respect to frame 144 by means of E-Rings 180. Rotation of the threaded screws 178 causes a vertical displacement of the backing plate 154 between the positions shown in FIGS. 6B and 6C. A washer 182 surrounding each of the screws 178 made of neoprene or other similar material separates the backing plate 154 from the armature plate 148 and provides for noiseless return of the armature plate 148 from the elevated position shown in FIG. 6B to a lowered rest position shown in FIG. 6A upon cessation of the magnetic field in the adjacent electromagnet.

Figure 7:
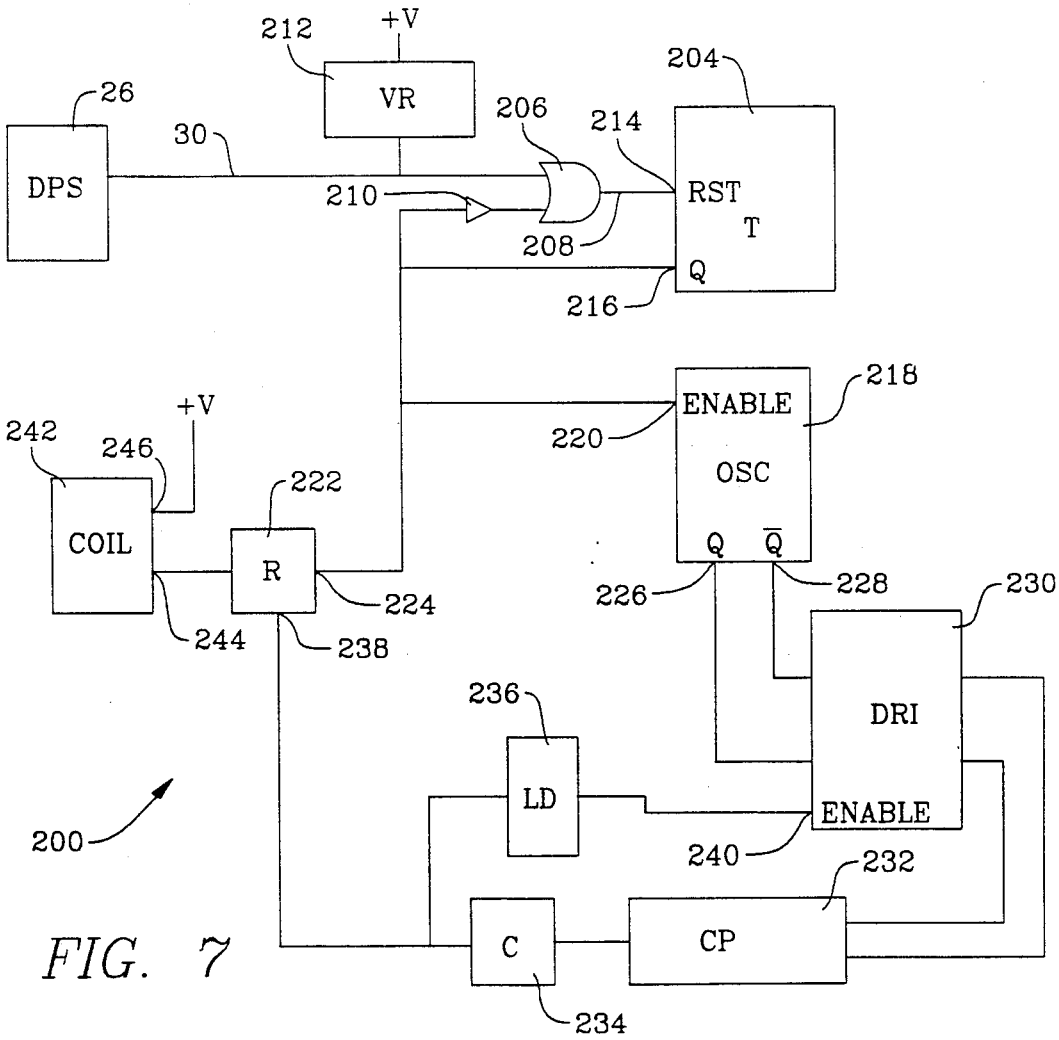
FIG. 7 is a schematic diagram of an electronic circuit for use in an electromagnetic door lock in accordance with the present invention.

While either embodiment of the armature assembly could be locked using and electromagnet supplied with power from any of a multitude of power supplies, the preferred embodiment of an electronic circuit used in an electromagnetic door lock for controlling the application of electrical power to electromagnet 20 in door frame 14 is shown in FIG. 7. Circuit 200 includes the door position sensor 26, a timing circuit means and a power circuit means. The timing circuit means consists of the one-shot timer 204, OR gate 206 and NOT gate 210. A voltage regulator 212 is electrically connected to supply a regulated voltage to the various element of the circuit 200. The door position sensor 26 is connected by line 30 to one input of OR gate 206. Line 208 electrically connects the output of OR gate 206 to the RESET input 214 of one-shot timer 204 and the Q output 216 of the one-shot timer 204 is electrically connected to the input of NOT gate 210. Additionally, the Q output 216 is also connected to the ENABLE input 220 of oscillator 218 and to the relay 222 at terminal 224. The Q output 226 and the Q output 228 of oscillator 218 are electrically connected through driver 230 to charge pump 232. The charge pump 232 is electrically connected to capacitor 234 which serves as a charge storage means. Capacitor 234 is then connected to level detector 236 and is also connected to relay 222 at terminal 238. The output of level detector 236 is attached to the ENABLE input 240 of driver 230 and the output of relay 222 is attached to the locking coil 242 at terminal 244. Positive voltage of magnitude +V is applied to the locking coil 242 at terminal 246.

The operation of the circuit 200 will now be described assuming that the lock is unpowered and the door 12 is open. The description of the normal operation of the circuit lies in three distinct areas: applying power to the lock, closing the door and then locking the lock. When power is applied to the lock through an external power source (not shown), the oscillator 218 begins to oscillate, thus providing signals on the Q output 226 and Q output 228 to driver 230. Charge pump 232 is driven by the high current push-pull square wave output signals that operate out of phase with each other which are provided by the driver 230. The charge pump 232 is and functions as a voltage amplifier. In the preferred embodiment, the charge pump consists of an eight-stage capacitor and diode arrangement designed to multiply the input voltage to the charge pump 232 by approximately 6 to 8 times. The action of charge pump 232 charges the storage capacitor 234 to a maximum voltage determined by level detector 236. When the threshold of the level detector 236 is reached during the charging of capacitor 234, the level detector produces an output which, when applied to ENABLE input 240, disables driver 230. The inclusion of level detector 236 into the circuit only allows the storage capacitor 234 to charge to a safe, predetermined level corresponding to the threshold voltage level set by the level detector 236. When this level is achieved, level detector 236 disables the driver 230, thus removing the input power from the charge pump 232.

As the door 12 is being closed, the small magnet 28 located in the armature 18 comes into close proximity to the door position sensor 26. As soon as the door position sensor 26 is triggered, a signal is sent to OR gate 206. This signal is then applied to the RESET input 214 of timer 204 over line 208 which causes the timer 204 to reset and start a new field selectable timing sequence which provides a relocking delay for the lock to the end user. After the timing period has expired, the Q output 216 of one-shot timer 204 goes high which accomplishes three different functions. First, a high level on the Q output 216 latches the RESET input 214 of one-shot timer 204 such that no further signals are accepted from door position sensor 26. Latching RESET input 214 is important because of the possibility that the door position sensor will sporadically respond to extraneous magnetic fields which would falsely reset the timer 204. The inclusion of NOT gate 210 and OR gate 206 comprises a latch which prevents any false stimulation of door position sensor 26.

The second function of the Q output 216 of one-shot timer 204 going high is that when it is applied to the ENABLE input 220 of oscillator 218, it causes the oscillator to be disabled. Disabling the oscillator 218 precludes the application of the signals from the Q output 226 and the Q output 228 through driver 230 to the charge pump 232 which effectively removes any input power to the charge pump 232. This also reduces the input power required by the oscillator 218 since it is no longer in operation.

The final and most important function of the Q output 216 of one-shot timer 204 going high is that it signals relay 222 to close. When the relay closes, the accumulated charge in capacitor 234 is discharged across coil 242 at terminal 244 and a positive predetermined voltage of magnitude +V is additionally applied to the coil 242 at terminal 246 to provide the enhanced power necessary for a locked condition to be achieved. After capacitor 234 is completely discharged, the positive voltage +V at terminal 246 will remain to keep the door in a locked condition.

Circuit 200 is capable of operating correctly when the door is closed before power is applied to the lock through the external power source (not shown). In this case, the door position sensor immediately resets one-shot timer 204 which constitutes an immediate signal to the circuit to begin the relocking procedure. One-shot timer 204 has a minimum time delay that allows the charge pump 232 to fully charge the capacitor 234 before the capacitor is discharged to the locking coil 242 to provide the enhanced power necessary for a locked condition to be achieved.

Although the invention has been described in detail with reference to the illustrated preferred embodiments, variations and modifications exist within the scope and spirit of the invention as described and as defined in the following claims.

What is claimed is:

1. An electromagnetic door lock assembly comprising:

an electromagnet positioned in a frame adjacent to a door;

an adjustable armature assembly positioned in the door for interaction with the electromagnet, the armature assembly including an armature plate and biasing means for biasing the armature plate away from the electromagnet;

a backing plate situated adjacent to a back surface of the armature plate, coupling means for coupling the backing plate to the armature plate, said biasing means biasing the backing plate and armature plate toward each other; and power means for providing power to the electromagnet sufficient to hold the armature plate in contact with the electromagnet, the power means including enhancing means for developing an initial enhanced current through the electromagnet to assure armature plate attraction to the electromagnet against the added force provided by the biasing means.

2. The door lock assembly of claim 1 wherein the coupling means comprises a first element fixed to the armature plate for movement therewith, the backing plate being movable with respect to the first element and said biasing means acting between the first element and the backing plate to bias the backing plate and armature plate toward each other.

3. The door lock assembly of claim 2 wherein the backing plate comprises a first surface confronting the back surface of the armature plate and a second surface opposite from the first surface, said first element projects through an opening in the backing plate, and said biasing means contacts the backing plate second surface.

4. The door lock assembly of claim 3 wherein said first element includes an enlarged end remote from the backing plate, said biasing means comprising a spring positioned between the enlarged end and the backing plate for applying a biasing force independent of the relative position between the backing plate and the mounting plate.

5. The door lock assembly of claim 1 wherein the armature assembly further comprises a mounting plate for mounting the armature assembly to said door to be locked, adjusting means for adjustably positioning the backing plate at a fixed position with respect to the mounting plate so that a front surface of the armature plate is positioned at a first position for optimum interaction with the electromagnet, and alignment means for maintaining the relative alignment between the armature plate and the mounting plate as the armature plate moves between said first position and a position contacting the electromagnet.

6. The door lock assembly of claim 5 wherein the mounting plate comprises a central channel receiving the armature plate and backing plate and integral mounting flanges at the ends of the central channel for mounting the armature assembly to said door to be locked.

7. The door lock assembly of claim 5 wherein the adjusting means comprises threaded elements engaging the backing plate and rotatable with respect to the mounting plate for adjusting the displacement of the backing plate with respect to the mounting plate.

8. The door lock assembly of claim 5 wherein the armature assembly further comprises spacer means for spacing the armature plate from the backing place by a selected minimum distance to prevent contact between the armature plate and backing plate upon return of the armature plate to the first position.

9. The door lock assembly of claim 1 wherein the armature plate includes a front surface having channel means for enveloping coordinate projections extending toward the armature plate from the electromagnet to inhibit relative lateral movement of the armature and electromagnet when the electromagnet is energized.

10. The door lock assembly of claim 1 further comprising a permanent magnet adjustably positioned with respect to a mounting plate for indicating the position of the door and armature assembly with respect to said electromagnet.

11. The door lock assembly of claim 10 further comprising door sensor means positioned in the door frame and coupled to the power means for developing a signal indicating the position of the armature assembly with respect to said electromagnet to permit delivery of power to the electromagnet by the power means when the door assumes a closed position.

12. The door lock assembly of claim 11 further comprising timing circuit means having an input coupled to an output of said door sensor means for producing a delayed output timing signal at an output of the timing circuit means in response to the armature assembly being in close proximity to said door sensor means, said timing circuit means output being coupled to said power means for applying power to the electromagnet in response to the delayed output timing signal.

13. The door lock assembly of claim 12 wherein said enhancing means comprises storage means having an output coupled to the electromagnet for storing power to be applied to the electromagnet, and amplification means having an output coupled to the storage means and an input coupled to the power means for applying amplified power to the storage means.

14. The door lock assembly of claim 13 wherein said storage means comprises a capacitor.

15. The door lock assembly of claim 13 wherein said amplification means comprises charge pump means having an input and having an output coupled to the storage means for charging the storage means, drive means for applying two out-of-phase signals to the input of the charge pump means, and oscillator means for providing an input signal at a particular frequency to the drive means.

16. The door lock assembly of claim 15 further comprising level detection means for disabling said drive means when said storage means is charged to a predetermined level.

17. The door lock assembly of claim 13 wherein said enhancing means further comprises relay means coupling the storage means and the electromagnet for allowing the storage means to discharge across the electromagnet in response to said delayed output from said timing circuit means.

18. The door lock assembly of claim 13 wherein said enhancing means further comprises level detection means for disabling said amplification means when said storage means is charged to a predetermined level.

19. The door lock assembly of claim 12 further comprising voltage regulation means coupled to said door sensor means and said timing circuit means for insuring that the magnitude of said signal from said door sensor means does not exceed a predetermined value.

20. An electronic circuit in an electromagnetic door lock for controlling the application of electrical power to a locking coil attached in a door frame, the locking coil being cooperatively arranged with an armature movably attached to a door in spaced relation to the locking coil, the electronic circuit comprising:

door sensor means for triggering a timing circuit means, in response to a small permanent magnet in the door, when the magnet is inc lose proximity to said door sensor means, for producing a delayed output timing signal in response thereto; and power circuit means for applying power to the locking coil in response to said delayed output from said timing means, the power circuit means including enhancing means for developing an initial enhanced current through the electromagnet to assure enhanced attraction of the armature plate, to overcome a bias on said armature plate away from the electromagnet, across the space therebetween when the door is closed thereby attracting the armature plate away from a backing plate toward which said armature plate is biased so that the door assumes a magnetically locked condition when the locking coil is powered and the door is closed.

21. The electronic circuit of claim 20 wherein said enhancing means comprises amplification means for applying amplified power to a storage means, said storage means for storing power to be applied to the locking coil.

22. The electronic circuit of claim 21 wherein said storage means is a capacitor.

23. The electronic circuit of claim 21 wherein said amplification means comprises oscillator means for providing an input signal at a particular frequency to a drive means, said drive means for applying two out-of-phase signals to a charge pump means for amplifying and applying said out-of-phase signals to said storage means.

24. The electronic circuit of claim 23 further comprising level detection means for disabling said drive means when said storage means is charged to a predetermined safe level.

25. The electronic circuit of claim 21 wherein said power circuit means further comprises relay means for allowing said storage means to discharge across said locking coil in response to said delayed output from said timing circuit means.

26. The electronic circuit of claim 21 further comprising level detection means for disabling said amplification means when said storage means is charged to a predetermined safe level required.

27. The electronic circuit of claim 20 further comprising voltage regulation means operating with said door sensor means and said timing circuit means, said voltage regulation means for insuring that the magnitude of said signal from said door sensor means does not exceed a predetermined value.

28. An adjustable armature assembly for use in an electromagnetic door lock comprising:

an armature plate having a front surface confronting an electromagnet for magnetically interacting therewith and having a back surface opposite the front surface, a backing plate situated adjacent to the back surface of the armature plate, coupling means for coupling the backing plate to the armature plate including biasing means for biasing the backing plate and armature plate toward each other, a mounting unit for mounting the armature assembly to a door to be locked, adjustable elements engaging the mounting unit having upper portions projecting through openings in the backing plate and armature plate, and having upper ends substantially coplanar with the armature plate front surface, the adjustable elements adjustably positioning the backing plate at a selected position with respect to the mounting plate so that the front surface of the armature plate is positioned at a first position spaced from the electromagnet, the upper portions of the adjustable elements maintaining the relative alignment between the armature plate and the mounting plate as the armature plate moves between said first position and a position contiguous to the electromagnet.

29. The armature assembly of claim 25 wherein the armature plate front surface includes channel means for enveloping coordinate projections extending toward the armature plate from the electromagnet to inhibit relative lateral movement of the armature and electromagnet when the electromagnet is energized and the armature and electromagnet are contiguous to each other.

30. The armature assembly of claim 25 wherein the coupling means comprises a first element,/fixed to the armature plate for movement therewith, the backing plate being movable with respect to the first element and said biasing means acting between the first element and the backing plate to bias the backing plate and armature plate toward each other.

31. The armature assembly of claim 30 wherein the backing plate comprises a first surface confronting the back surface of the armature plate and a second surface opposite from the first surface, said first element projects through an opening in the backing plate, and said biasing means contacts the backing plate second surface.

32. The armature assembly of claim 31 wherein said first element includes an enlarged end remote from the backing plate, said biasing means comprising a spring positioned between the enlarged end and the backing plate for applying a biasing force independent of the relative position between the backing plate and the mounting plate.

33. The electronic circuit of claim 20, further comprising:

means for latching a reset input to the timing circuit means and for thereby allowing said door sensor means to respond only to proximity of the small permanent magnet in the door.

* * * * *